US006758335B2

(12) United States Patent
Kajiya

(10) Patent No.: US 6,758,335 B2
(45) Date of Patent: Jul. 6, 2004

(54) PDA CASE

(76) Inventor: Kevin Kajiya, 711 Bent Ridge La., Elgin, IL (US) 60120

( * ) Notice: Subject to any disclaimer, the term of this patent is extended or adjusted under 35 U.S.C. 154(b) by 180 days.

(21) Appl. No.: 10/073,563

(22) Filed: Feb. 12, 2002

(65) Prior Publication Data

US 2003/0150756 A1 Aug. 14, 2003

(51) Int. Cl.[7] ..... B65D 85/00
(52) U.S. Cl. ..... 206/320; 206/472
(58) Field of Search ..... 206/320, 472, 206/473, 477, 483, 569, 305, 576, 810; 190/102; D18/7, 11, 12, 2; 150/135, 145

(56) References Cited

U.S. PATENT DOCUMENTS 4,635,797 A * 1/1987 Bankier ..... 206/472
4,832,191 A * 5/1989 Gerver et al. ..... 206/232
D311,220 S * 10/1990 Kam ..... D19/26
5,375,883 A * 12/1994 Wyant ..... 281/37
5,560,476 A * 10/1996 Lee ..... 206/38
5,685,430 A * 11/1997 Weisburn et al. ..... 206/455
5,901,842 A * 5/1999 Berger ..... 206/232
6,145,661 A * 11/2000 Jung ..... 206/320
6,244,400 B1 * 6/2001 Bowers ..... 190/110
6,264,029 B1 * 7/2001 Motson ..... 206/320
6,286,667 B1 * 9/2001 Lee ..... 206/38

* cited by examiner

*Primary Examiner*—Jila M. Mohandesi
(74) *Attorney, Agent, or Firm*—Dillis V. Allen, Esq.

(57) ABSTRACT

A carrying case for a PDA(organizer-data receiver transmitter) that permits the PDA to be swung out of the case for connection to a charger or other peripheral devices without detaching the PDA from the case. A flexible flap permits this and is pivotally connected at one end in the case and attached by loop and hook connectors to the rear of the PDA.

8 Claims, 3 Drawing Sheets

30
15a
16
36
20
21
39
38
18
23
25
10
14
13
30
10
30
16
18
15
12

43
10
14

30

40
36
18
13

12
13

PDA CASE

BACKGROUND OF THE INVENTION

Many users of PDA devices(personal data assistants) desire a carrying case, usually a flexible one, to carry, cover and protect their PDAs. Carrying cases, however, inhibit the attachment or connection of the PDA to peripheral devices such as chargers, car mounts, keyboards, and data devices—unless the PDA is completely removed from the case.

When removing the PDA from the case, it frequently slips from the user's grasp because both the case and PDA must be manipulated at the same time.

A primary object of the present invention is to ameliorate the problems noted above in carrying cases for PDAs.

SUMMARY OF THE PRESENT INVENTION

In accordance with the present invention, a carrying case for a PDA(personal data assistants) is provided that permits the PDA to be swung out of the case for connection to a charger or other peripheral devices, such as keyboards, USB devices, data devices, and car mounts, without detaching the PDA from the case.

Toward this end, a flexible flap is provided that is pivotally connected at one end in the case and attached by loop and hook connectors(or other mechanical or adhesive fasteners) and adhesive to the rear of the PDA. The flexible flap is attached inside and at the top of the case and the loop and hook connectors are positioned to be attached to the PDA on its upper rear surface with the PDA properly aligned in the case.

While the specific embodiment disclosed in the drawings is a case with a vertical side hinge, it should be understood that the objects of the present invention can be incorporated into a case with a horizontally hinged cover flap as well. In the case of a horizontally hinged cover flap, the case can be used to hold the PDA in an upright position on a horizontal surface like a travel alarm with the base of the PDA seated in the top inside of the cover of the case.

Also, the case can include an ID flap on the outside of the cover and may also include a outwardly extending boss on the outside rear panel of the case that receives a swiveling belt clip. The case is fully zippered to minimize exposure of the PDA to dirt, moisture and minor impacts.

It should also be understood that the definition of a PDA, according to the present specification, includes not only devices commonly known as PDAs, but also cellular phones, testing equipment, CD players, mini-computers, cameras, MP3 players, radios, and some other electrical devices.

According to the present invention, the pivoting flap also assists in repositioning the PDA into the case, and in the swift removal of the device from the carrying case.

It should also be understood that while the carrying case is zippered in flexible leather, according to the present invention, which is the preferred design, that some of the principles of the present invention can be applied to rigid cases as well.

Other objects and advantages of the present invention will be more apparent from the following detailed description.

DETAILED DESCRIPTION OF THE PREFERRED EMBODIMENT

Figure 7:
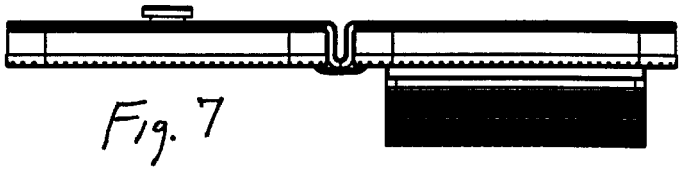
FIG. 7 is a top view of the PDA case in its open configuration with the PDA exploded therefrom and unattached.
Figures 3, 4, 6:
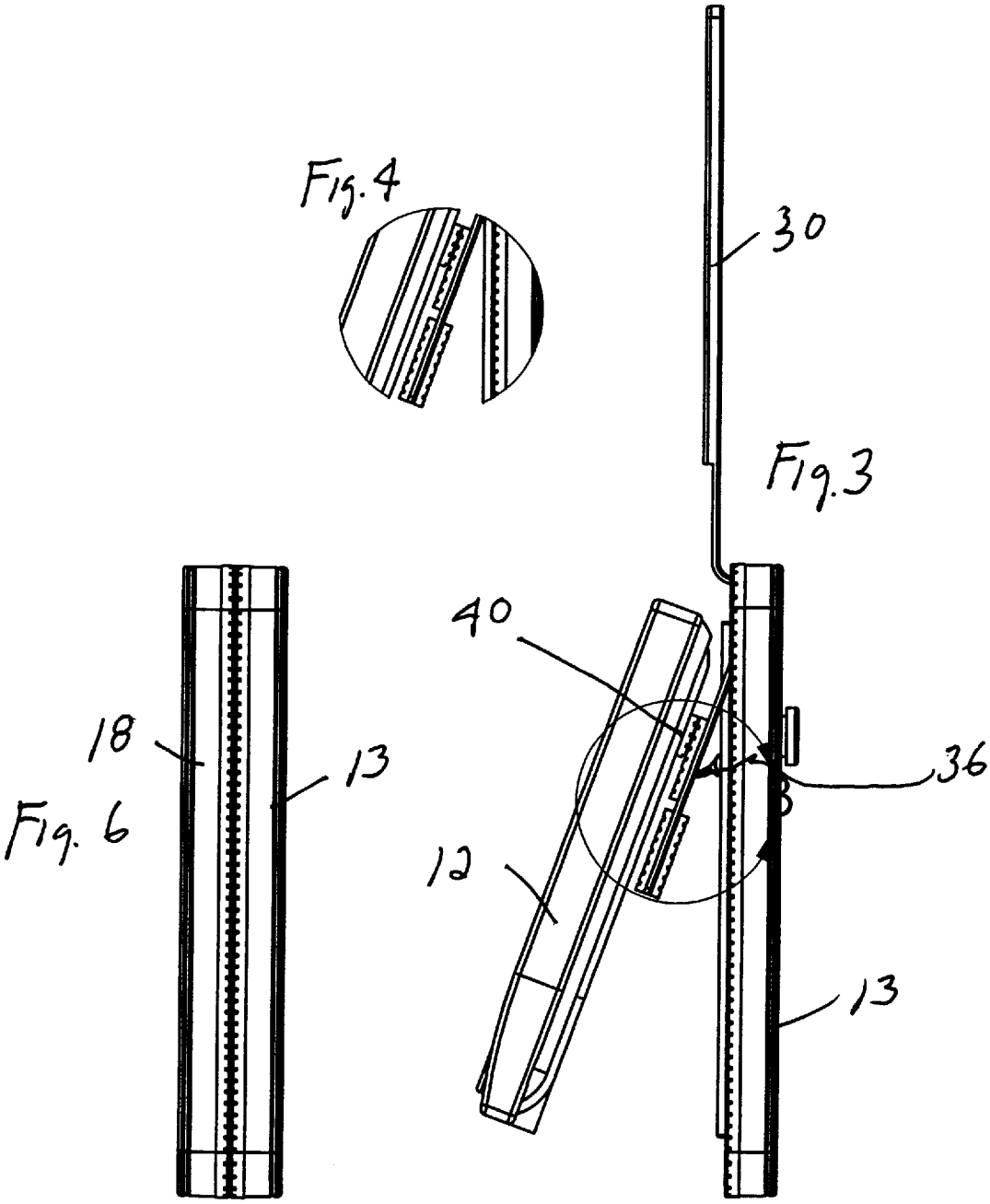
FIG. 3 is a right side view of the PDA case illustrated in FIGS. 1 and 2 with a PDA attached to the PDA flap.
FIG. 4 is an enlarged circular fragmentary view taken from FIG. 3 showing the flap connected to the PDA.
FIG. 6 is a side view of the PDA case illustrated in FIGS. 1 to 5 with the case closed.

Referring to the drawings, a carrying case 10 is illustrated for enclosing and protecting a PDA 12 illustrated in FIGS. 3 and 7, and for other wireless devices such as cellular phones, small testing devices or cameras, mini-computers, CD players, MP3 players, and radios. Case 10 is preferably a flexible leather or vinyl and zippered, but it should be understood that other types of cases such as rigid cases, while not preferred, do come within the scope of certain features of the present invention.

The case 10 includes a base 13 having a rectangular rear panel 14 and four upstanding side walls 15 connected together in four arcuate corners 16. A cover 18 closes the base 13, and includes a front panel 20 and four side walls 21 connected together in arcuate corners. The cover 18 is hinged along a vertical axis by a flexible hinge 23, to the left side of the base 13. The base 13 and the cover 18 have first and second zipper portions 24 and 25 that completely close the cover 18 over the base 13.

Figures 1, 1A, 5:
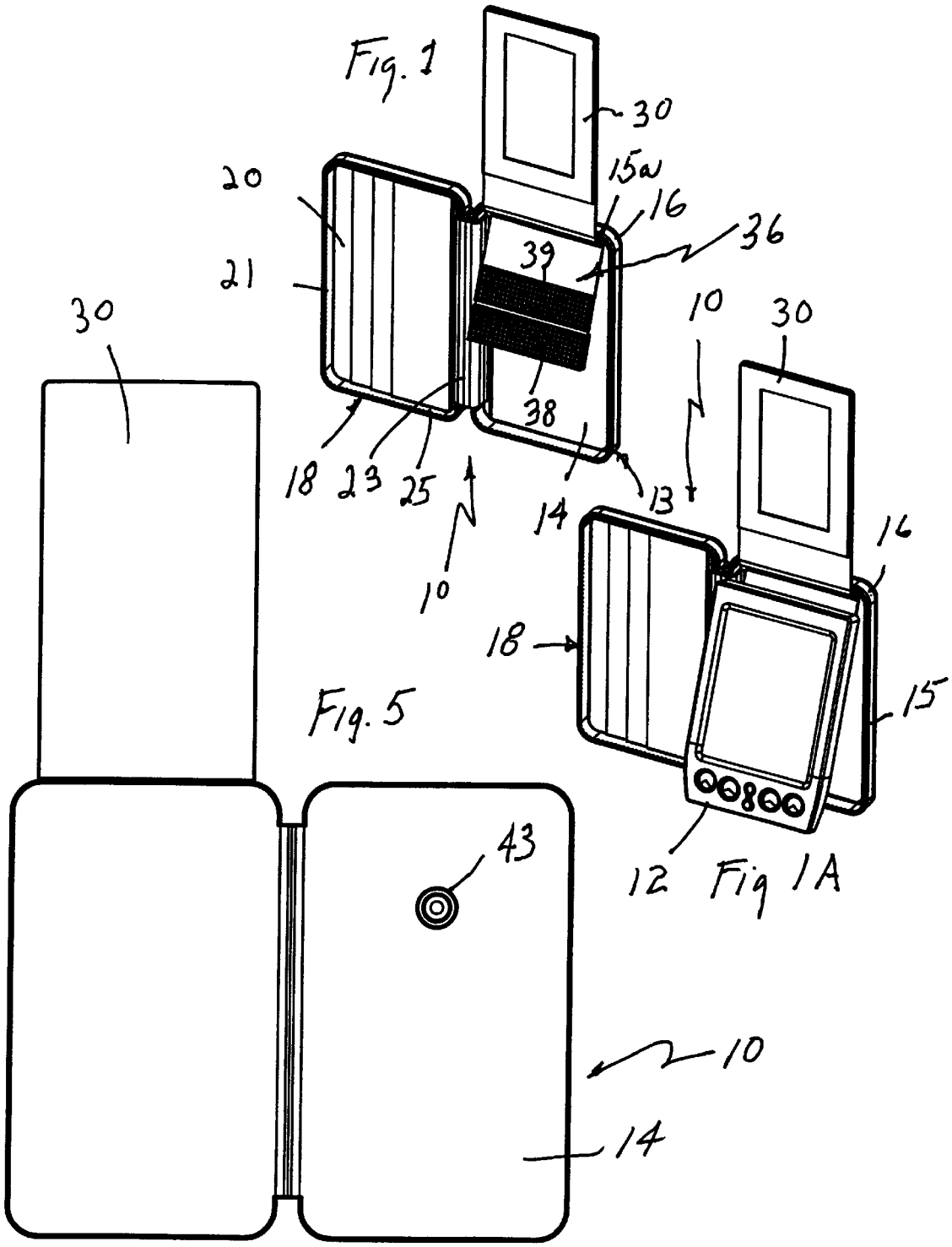
FIG. 1 is a perspective view of a PDA case according to the present invention with the case open illustrating the PDA flap and an owner ID flap.
FIG. 1A is a perspective view of a PDA case according to the present invention similar to FIG. 1 with a PDA attached to the PDA flap.
FIG. 5 is a rear view of the PDA case illustrated in FIGS. 1 to 4.
Figure 2:
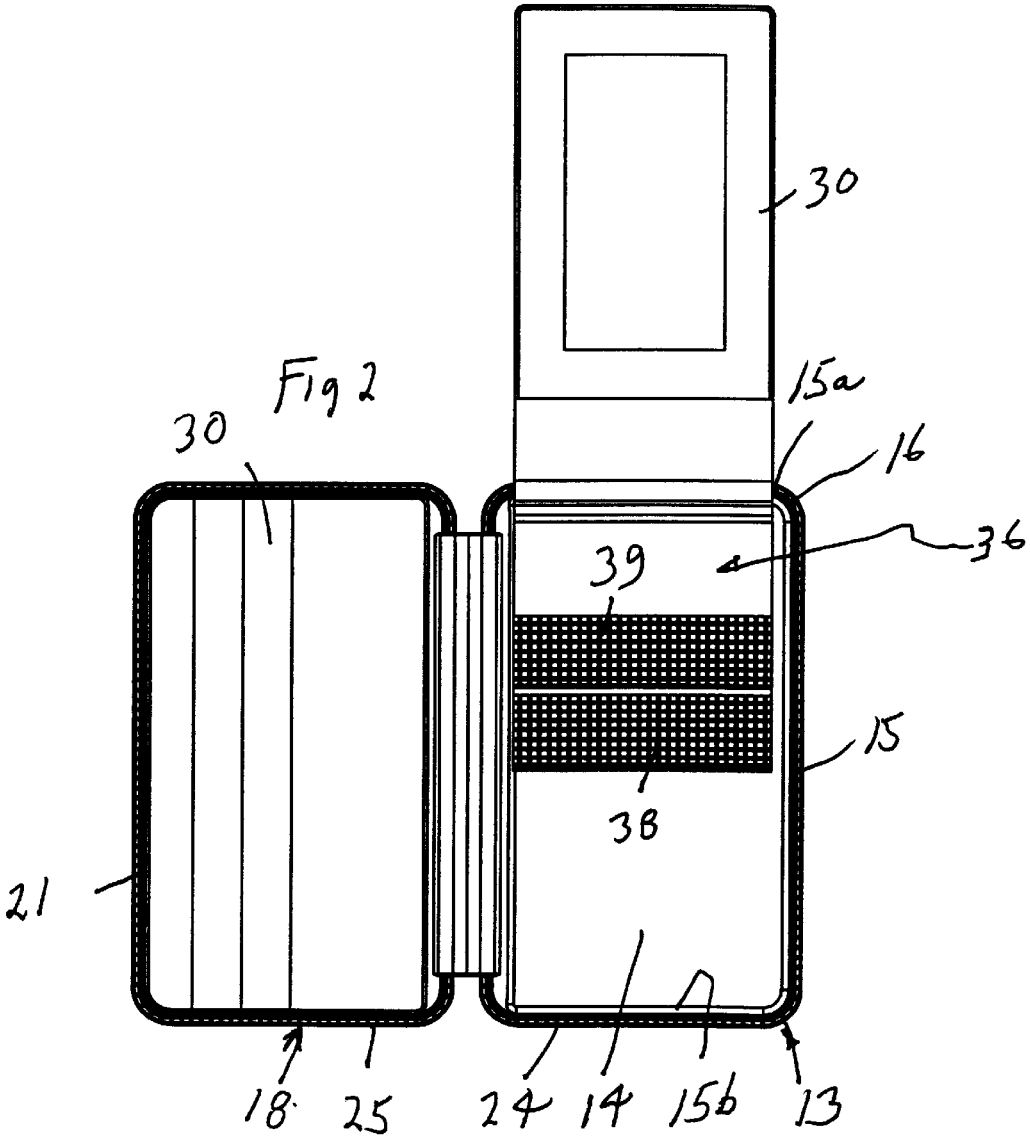
FIG. 2 is a front view of the PDA case illustrated in FIG. 1.

An ID flap assembly 30 is pivotally mounted inside the base to the top of the rear panel 14 or the underside of the upper side wall 15 as shown in FIGS. 1, 2 and 3. It should be understood that the ID flap 30 could also be mounted to the outside forward surface of the front panel 20 on the cover 18.

A flexible PDA flap 36 is fixed on a horizontal line at the upper inside portion of the base rear panel 14 as shown in the drawings, or alternatively, along the inside of the upper base side wall 15*a*. Flaps 30 and 36 can be fixed into the base 13 either by sewing or some other process such as heat welding when synthetic thermoplastic elastomeric materials are utilized to construct the case 10.

The flap 36 has a vertical length of slightly more than one-half the total height of the case and carries on its lower forward surface one-half of a flexible hook and loop connector strip 38. A second strip 39 may also be provided so that one of the strips 38 and 39 can be removed to accommodate the best location on the rear of the PDA.

The other halves of the connector strips 38 and 39 are fixed at 40 to the rear of the PDA in a position where it will not interfere with any PDA functions.

In use, the case purchaser simply fixes a Velcro strip to the rear surface of the PDA 12 at a location where it will not interfere with any functions, and in a position where it is aligned with one of the strips 38 or 39 when the PDA's lower edge 42 is about ⅛th inch up from the lower base side wall 15*b* illustrated in FIG. 2. The two hook and eye halves are then locked together with the PDA 12 in proper alignment in the base 13.

When it is desired to use the PDA 12 with some peripheral device, the PDA is swung outwardly in the direction shown in FIG. 3, and inserted into the peripheral device which in some cases requires that the base 13 be located to the rear of the peripheral device; for example, if it be one of the vertical type charging holders that surround the PDA 12. Also, as seen in FIG. 5, the outside of the rear panel 14 may be provided with a swivel boss 43 for receiving a pivotal belt clip not shown.

What is claimed is:

1. A PDA case, comprising: a base having a rear panel with upstanding side panels, the side panels carrying a first zipper portion, a cover panel pivotally connected to the base and carrying a second zipper portion engageable with the first zipper portion on the base, and means to attach a PDA to the base to permit the PDA to be attached to peripheral devices without detaching the PDA from the base including means to permit the PDA to swing outwardly from the base about an axis parallel to and spaced from the PDA.

2. A PDA case as defined in claim 1, wherein the means to attach the PDA to the base includes a flap pivotally mounted at one end to the base and having at its other end attachment means for attachment to the rear of the PDA.

3. A PDA case as defined in claim 2, wherein the flap is flexible.

4. A PDA case as defined in claim 1, wherein the base and cover panel are flexible.

5. A PDA case, comprising: a base having a rear panel with upstanding side walls, a cover panel pivotally mounted on the base, a closure for holding the cover panel against the base in a closed position, and a flap panel pivotally mounted in the base at one end and having a connecting device at its other end, said flap panel being pivotally connected to the base about an axis parallel to and spaced from the PDA.

6. A PDA case as defined in claim 5, wherein the connecting device at the other end is constructed to be attached to the rear of a PDA.

7. A PDA case as defined in claim 6, wherein the connecting device is a flexible hook and loop connector.

8. A PDA case as defined in claim 5, wherein the flap panel is adapted to be connected to a PDA to permit the PDA to be swung out of the base for attachment to a peripheral device without removing the PDA from the base.

* * * * *